United States Patent [19]

Weiss

[11] 4,397,586

[45] Aug. 9, 1983

[54] OFFSHORE ARCTIC STRUCTURE

[75] Inventor: Richard T. Weiss, Houston, Tex.

[73] Assignee: Exxon Production Research Co., Houston, Tex.

[21] Appl. No.: 322,628

[22] Filed: Nov. 9, 1981

Related U.S. Application Data

[63] Continuation of Ser. No. 55,214, Jul. 6, 1979, abandoned.

[51] Int. Cl.[3] ..... E02B 17/00

[52] U.S. Cl. ..... 405/217; 405/61; 405/127; 405/211

[58] Field of Search ..... 405/61, 127, 195, 203, 405/205, 207, 211, 217, 224, 226, 227; 175/5, 8, 9; 114/256, 257, 264

[56] References Cited

U.S. PATENT DOCUMENTS

| | | | |
|---|---|---|---|
| 180,087 | 7/1876 | Cole | 405/127 |
| 3,312,275 | 4/1967 | Daltry et al. | 165/134 X |
| 3,868,920 | 3/1975 | Schirtzinger | 114/42 X |
| 3,910,056 | 10/1975 | Dopyera | 405/211 |
| 3,911,687 | 10/1975 | Mo | 405/225 |
| 3,928,982 | 12/1975 | Lacroix | 405/224 |
| 3,952,527 | 4/1976 | Vinieratos et al. | 405/217 |
| 3,972,199 | 8/1976 | Hudson | 405/217 |
| 4,048,943 | 9/1977 | Gerwick | 114/256 |
| 4,055,052 | 10/1977 | Metge | 405/217 |
| 4,080,798 | 3/1978 | Reusswig | 405/217 |
| 4,094,149 | 6/1978 | Thompson et al. | 405/217 X |
| 4,114,394 | 9/1978 | Larsen | 405/211 X |
| 4,118,941 | 10/1978 | Bruce et al. | 405/211 X |

OTHER PUBLICATIONS

Kovacs, A., and Sodhi, D. S., "Shore Ice Pile-Up and Ride-Up", Preprint, Office of Naval Research, Workshop on Problems of the Seasonal Sea Ice Zone, Naval Postgraduate School, Monterey, California, Feb. 26–Mar. 1, 1979.

Cranfield, J., "New Concepts Mobile Rig Design for Arctic Waters", *Ocean Industry* (Mar. 1976), pp. 77, 79.

Croasdale, K. R., Metge, M., and Verity, P. H., "Factors Governing Ice Ride-Up on Sloping Beaches", Proceedings for the International Association for Hydraulic Research, Symposium on Ice Problems, Lulea, Sweden, Part I, pp. 405–420, 1978.

*Primary Examiner*—David H. Corbin

*Attorney, Agent, or Firm*—Keith A. Bell; Marc L. Delflache

[57] ABSTRACT

An apparatus is disclosed for minimizing the horizontal forces on an offshore arctic structure due to ice movement. The structure includes a base portion, sloped side walls and a smooth, unobstructed top portion. The structure is substantially submerged in a body of water with the top portion at or near the water surface permitting floating ice sheets which strike the side walls to flex slightly upward and advance along and over the structure without substantially destroying the overall integrity of the ice sheet. In this manner, the horizontal forces on the structure resulting from the ice sheet are minimized due to the elimination of a crushing failure mode of the ice sheet commonly associated with conventional offshore arctic structures.

25 Claims, 10 Drawing Figures

OFFSHORE ARCTIC STRUCTURE

This is a continuation, of application Ser. No. 055,214, filed July 6, 1979, now abandoned.

BACKGROUND OF THE INVENTION

1. Field of the Invention

This invention relates to an improved apparatus for use in an offshore arctic environment. More particularly, this invention relates to an offshore structure located at or near the water surface and capable of housing equipment and even personnel wherein moving ice sheets floating along the surface of the water are deflected over the structure in a single mass.

2. Description of the Prior Art

There is a need in any offshore area where large moving ice sheets are encountered for a simple, inexpensive structure, capable of housing equipment and possibly even personnel and capable of withstanding the lateral loads due to the ice sheets striking the structure. Yet, the structure cannot be entirely submerged below the ice since access during ice free periods is required. Thus, the structure should be at or near the water surface.

Hudson et al, U.S. Pat. Nos. 3,972,199, (1976), Gerwick, 4,048,943, (1977), and Cranfield, J., "New Concept: Mobile Rig Design For Arctic Waters", *Ocean Industry* (March, 1976), pp. 77, 79 disclose several types of arctic caisson designs. However, these designs are fairly massive for the relatively simple task of housing equipment. Industry has long recognized the need for a simplified offshore arctic structure which is easy to fabricate and install in primarily shallow waters. However, design problems are encountered in developing a structure which is capable of withstanding the tremendous lateral loads associated with a striking ice sheet.

A specific example of the need for a simple, offshore structure capable of housing remotely operated equipment is found in a recovery technique for oil and gas. In the depletion of an oil reservoir it is occasionally necessary to inject large amounts of water into a producing well which extends from the ground surface into the reservoir. This secondary recovery procedure is termed waterflooding. The purpose of waterflooding is to displace the underground oil with the injected water thereby increasing the reservoir's productivity. As onshore oil production on the North Slope of Alaska increases, there is a need for large quantities of water to perform this waterflooding operation. Obviously, one of the preferred sources of water is the ocean since, typically, the onshore drilling site is relatively close to the shore line. However, pumping sea water onshore in the quantities desired for a waterflooding operation requires not only a large pipeline, i.e., 4–6 feet in diameter, but also a substantial amount of pumping equipment. The pumping equipment could be located offshore on a conventional floating or fixed structure. However, such offshore structures are very expensive and require a substantial lead time for their design and fabrication. Thus, while conventional arctic structures such as Hudson et al exhibit utility in supporting large drilling equipment, room for improvement remains in attempting to reduce the overall cost of such a structure while maintaining their ability to resist the large lateral loads.

SUMMARY OF THE INVENTION

Recognizing the need for an improved offshore structure, applicant's invention is an enclosed frustrum-shaped structure having an interior chamber capable of housing equipment and even personnel. The top of the structure is flat and designed to be located at or near the surface. Thus, the striking ice sheets are not required to break in the traditional crushing type failures and float around a vertically extending member; rather, the ice sheet is deflected upwardly, riding over the structure and returning to the water surface once it passes. Thus, the ice sheet remains intact. The lateral or horizontal load on the structure resulting from this deflecting, ride-over mode of the ice sheet is substantially less than that resulting from the crushing type failures.

Preferably, applicant's structure is circular in plan view; however, for ease of fabrication a rectangular or square shaped structure is satisfactory.

The structure also includes a plurality of compartments located along the peripheral edge of the interior of the structure. These compartments assist in the installation of the structure.

In a modification of the invention, the sloped walls and top portion are chemically or thermally treated to reduce the adhesion of the ice sheet to the structure. In this manner, the frictional forces associated with the movement of an ice sheet up, onto and over the structure are further minimized.

In another modification of the invention, the structure includes a means for fixing the structure to the sea floor. Preferably, such a fixing means is piles penetrating into the sea floor. However, such may also be accomplished by maintaining the compartments flooded or filled with sand, gravel or the like following installation such that the compartments act as ballast tanks essentially providing a gravity based system.

In yet another modification of the invention, the structure is embedded a predetermined amount into the sea floor to prevent wave and current scour around and under the structure. If the structure is connected to the shore by means of a pipeline or the like, the embedment will also protect the pipeline against ice scour (scraping of the sea floor by irregular ice shapes protruding from the bottom of the ice sheet).

BRIEF DESCRIPTION OF THE DRAWINGS

In order that the features of this invention may be better understood, a detailed description of the invention, as illustrated in the attached drawings, follows.

DETAILED DESCRIPTION OF THE INVENTION

Applicant's invention is directed to an offshore arctic structure which is designed to be located substantially below yet at or near the water surface. This provides easy access to the structure and also substantially reduces the lateral load resulting from the striking ice sheets by changing the ice sheet/structure contact mode from a crushing type failure mode to a deflecting, ride-over mode.

Figure 1:
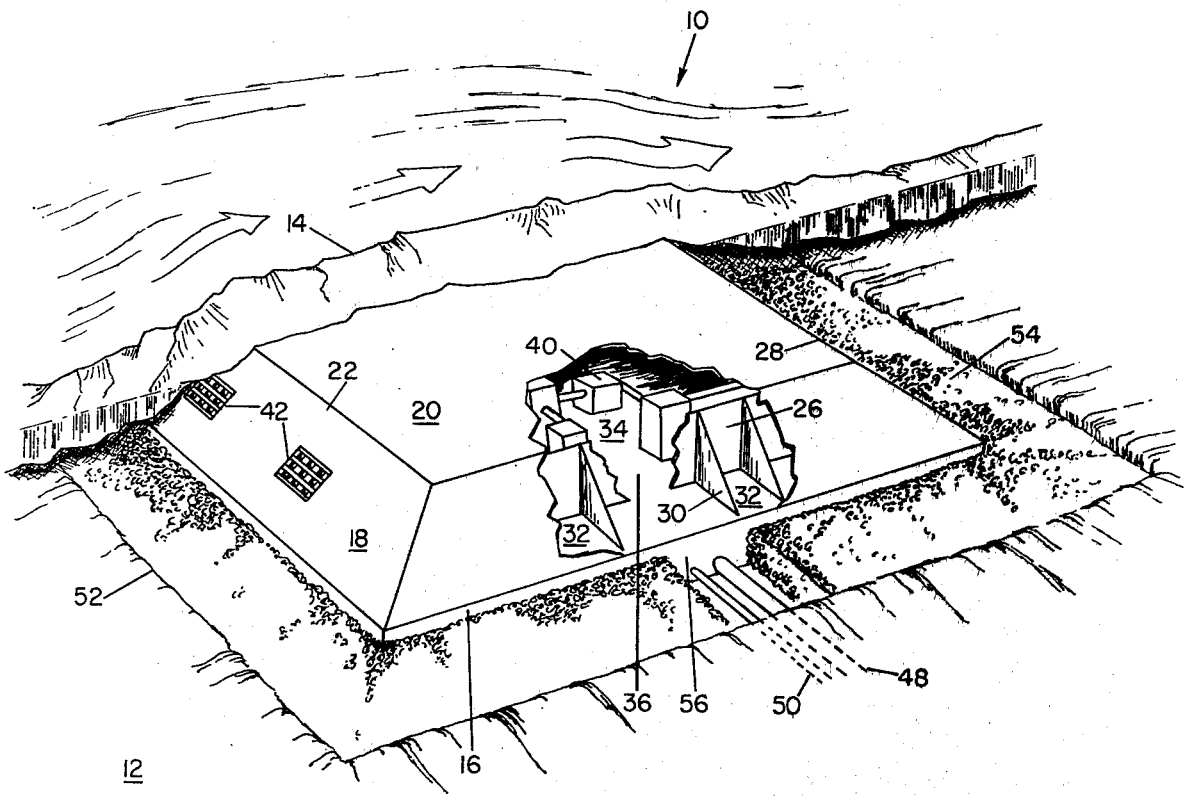
FIG. 1 is a cut-away perspective view of a structure embodying the present invention in its final position on the sea floor.

With reference to FIGS. 1 through 6B and with particular reference to FIG. 1, an offshore structure 10 is shown submerged on the sea floor 12. Obviously, the structure is not limited to application in the sea. It may be used in any aquatic environment such as rivers, lakes, etc.

In FIG. 1 a floating ice sheet 14 is shown flexing upward slightly as it rides over the structure 10. The structure comprises essentially a base portion 16 which is in contact with the sea floor 12, side walls 18 which slope upwardly and inwardly with respect to the base portion 16, and a smooth top portion 20 which contacts the upper end 22 of the sloped side walls 18. The base portion includes a bottom section 17 (see FIGS. 3A and 5) which contacts the sea floor and a side section 19 which extends vertically upward from the bottom section 17 to the lower end 21 of the side walls. To perform its intended function the structure need not rest on the sea floor. The structure may be supported by a submerged substructure, such as a platform (not shown) provided the top portion 20 of the structure is at or near the surface. Thus, the amount of bending which the ice sheet 14 must undergo to ride over the structure is minimized.

The structure includes a bulkhead 26 which connects the outer edge 28 of the top portion 20 with the base portion 16. The sloped walls 18 are reinforced by a plurality of web members 30 which interconnect the sloped walls 18, bulkheads 26 and base portion 16. A series of compartments 32 are defined around the inside periphery of the structure between the side walls, base portion and bulkhead. As discussed below, the compartments assist in the installation of the structure.

The structure includes an interior chamber 34 bounded by the top and base portions and the bulkhead. In this manner, the top surface 36 of the base portion 16 within the chamber 34 serves as a work platform. Operational equipment 40 is located on the work platform within the chamber 34.

In the preferred embodiment the structure is employed as an offshore pump station for waterflooding operations. Thus, a series of inlet ports 42 are located along the outside surface 44 (FIG. 5) of the sloped walls which connect via a conduit 46 to the pumping equipment 40. The pumping equipment is in turn connected to an exterior conduit 64. The conduit 64 is connected to a pipeline 48 which extends from the base portion to the onshore site. As an offshore pump station the structure is a self-contained unit which intakes water through the inlets 42 and pumps it to shore via the pipeline 48. Typically, the invention would also include a smaller pipeline 50 which supplies the necessary fuel or electricity to operate the equipment within the chamber 34. Since the present invention is not limited to application as an offshore pump station the chamber 34 may be used for other purposes than housing pumping equipment such as housing crews, conducting laboratory research, storing equipment, etc.

In certain cases the under side features of the ice sheet may extend to the sea floor. In such event, the sloped walls should also extend to the sea floor. To accomplish such the structure should be embedded in an excavated cavity 52. Embedment is preferred for several reasons; firstly, protection of the pipeline 48, 50 from ice scour damage, secondly, enhancement of the lateral stability of the structure, and thirdly, additional soil bearing capacity if the top layer of soil is soft.

Figure 2:
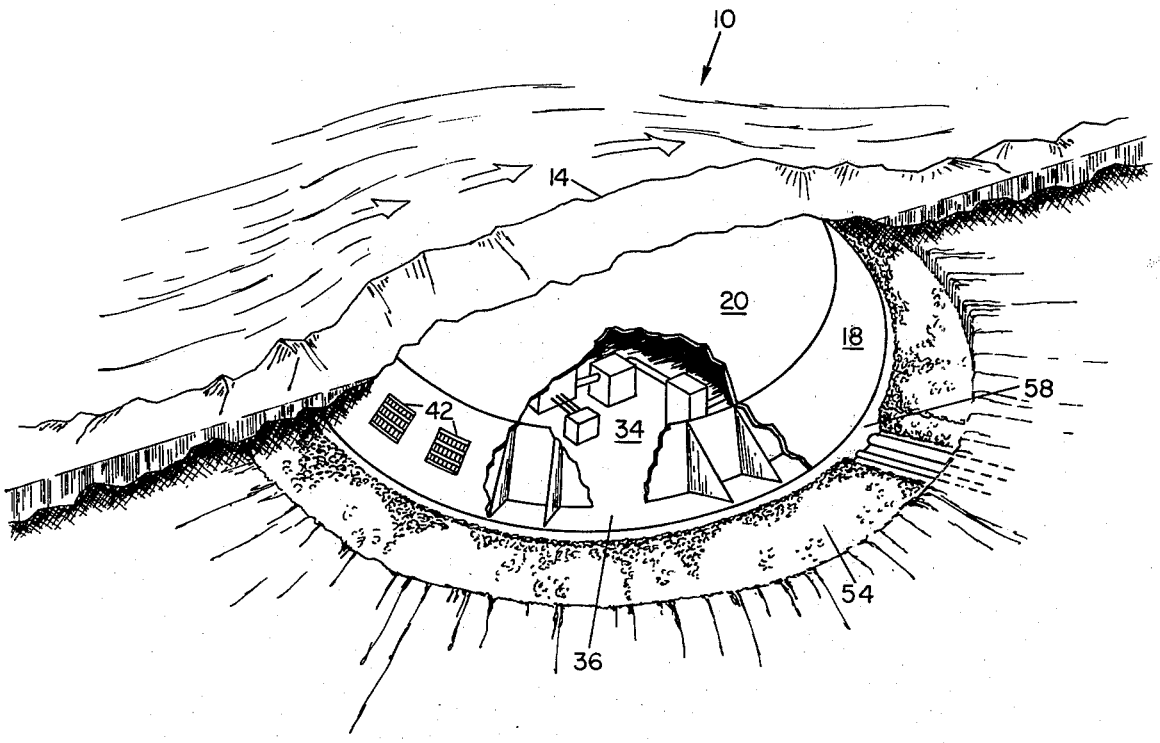
FIG. 2 is another cut-away perspective view of a structure embodying the present invention similar to FIG. 1; however, the structure is shown as having a circular shape.

The structure is not limited to a rectangular or square-shaped configuration. As illustrated in FIG. 2, the structure may be circular in shape. Functionally, the invention operates the same. The circular shape is optimum in that it experiences minimum ice loading. However, from a fabrication standpoint, the rectangular or square-shaped structure is preferred. The exterior horizontal dimensions of the rectangular configuration should preferably not exceed a ratio of 2:1 since the structure would have a more difficult time stabilizing itself in the narrow dimension when struck by an ice sheet in the broader dimension if the ratio exceeded 2:1.

The installation of the structure is illustrated in FIG. 3A-3D. The structure, initially buoyant, is towed as a barge to its final location. Once on site, the compartments 32 are flooded (FIG. 3B) lowering the structure In this manner the compartments 32 serve as ballast tanks. Yet, the compartments may also serve as trim tanks to stabilize the structure within the water during tow.

The sea floor 12 is initially prepared to accommodate a final embedment of the structure a predetermined depth, i.e. 4–6 feet. Site preparation would typically be accomplished by dredges or the like. Soil is removed not only from the location directly below the structure but also a predetermined distance, i.e. 10–20 feet, from the perimeter of the structure to allow for some imprecision in placement. Alternatively, the structure may be provided with high pressure water jets (not shown) which forcibly disperse streams of high speed water toward the sea bottom thereby displacing the soil immediately below and beneath the structure in addition to a predetermined area around the structure. The use of such jets is well known in the art. After setting the structure, gravel 54 is placed within the exposed section of the cavity 52 around the structure. The gravel serves several purposes. It protects the pipelines 48 and 50 and the structure from ice scouring, and it prevents erosion of the soil at the base of the structure caused by waves and current turbulence.

Since the pipeline 48 is typically 4–6 feet in diameter, the side 56 (for a rectangular-shaped structure, see FIG. 1) or region 58 (i.e., a 30° arc for a circular-shaped structure, see FIG. 2) of the base portion which the pipeline 48 connects with may be slightly deeper than the other sides or regions of the base portion to accommodate the large diameter pipelines and ensure that the top of the pipeline is also buried a minimum depth (i.e., 3 feet) in the gravel. In such event, that portion of the cavity 52 adjacent the deeper side 56 or region 58 of the structure would be excavated slightly deeper (see FIG. 3B).

Figure 3A:
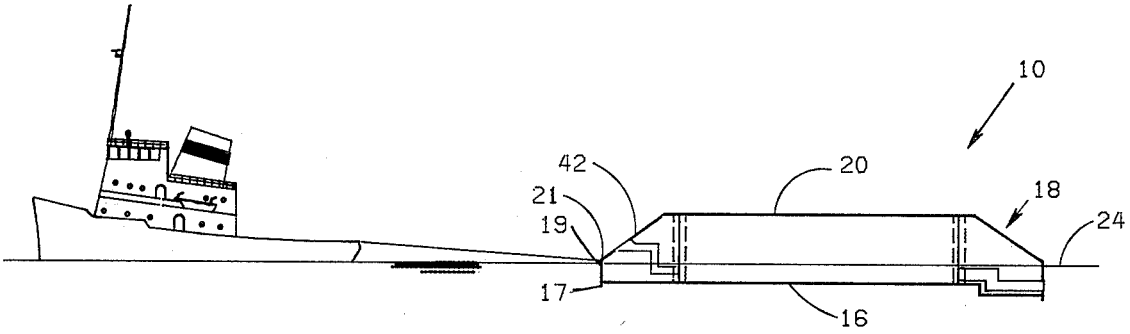
FIGS. 3A–3D are sequential installation views of a structure embodying the present invention.
Figure 3B:
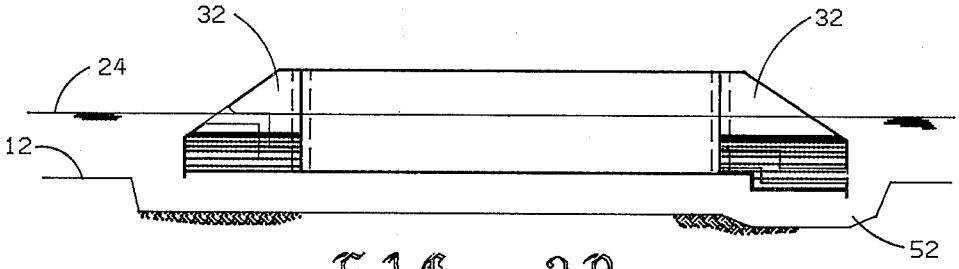
Figure 3C:
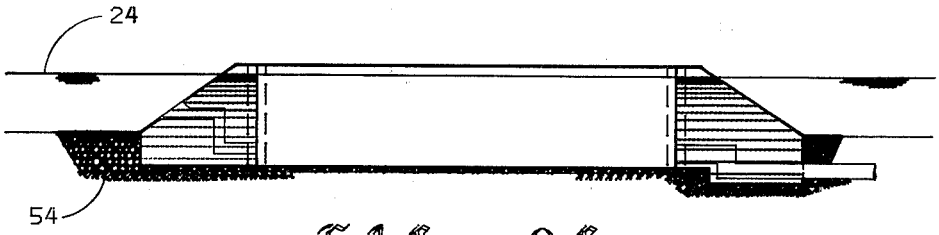
Figure 3D:
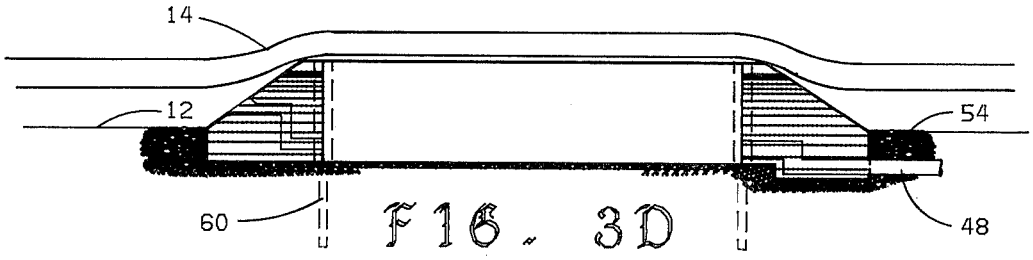

Once submerged on location as shown in FIG. 3C, it may be desirable to further improve the lateral stability of the structure. This may be accomplished by piles 60 which extend from the interior of the structure into the sea bottom or, alternatively, by increased mass such as filling of the compartments 32 with sand, gravel or the like. Specific details as to the location of the piles and alternate means to fix the structure to the sea bottom are described in greater detail below.

Figure 4:
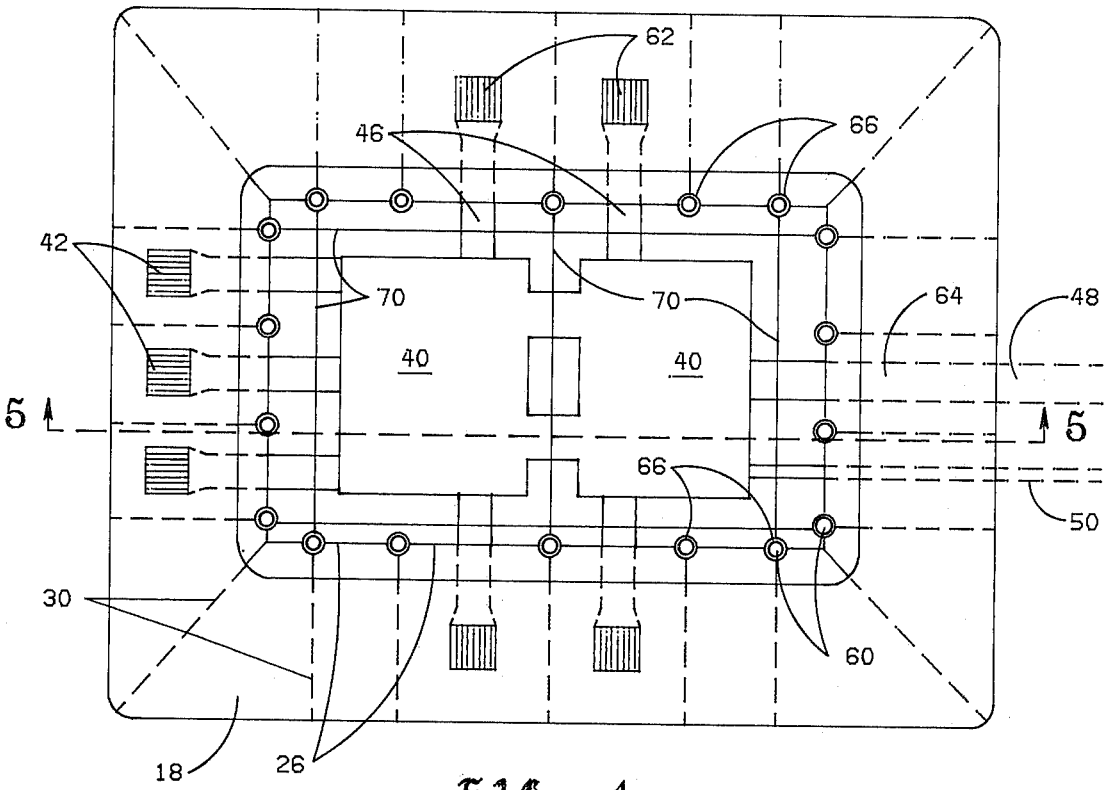
FIG. 4 is a plan, interior view of a structure embodying the present invention having a rectangular configuration.

FIG. 4 is a detailed plan view of the structure as illustrated in FIG. 1. The side walls are sloped between 30° and 60° with the horizontal, preferably 45°, to minimize the loads associated with the upward flexing of an ice sheet.

As noted earlier, the preferred embodiment includes a plurality of inlet ports 42. The inlets are preferably covered with a screen 62 which permits the ice to slide up and down the sloped walls yet prevents ice fragments from entering a conduit 46 which extends from the inlet to the pumping equipment. Typically, more inlets are provided than necessary should several become impacted by ice or other matter. The structure may include a means for backwashing the inlets (not shown) which could flush out any impacted ice or debris. Such a backwashing system will know in the art, would actually be part of the pumping equipment.

As noted above, the pipeline 48 attahes to the extension conduit 64 within the structure which extends from the side section 19 to the pumping equipment. Similarly, another exterior conduit 64' attaches to the pipeline 50 extending it from outside the structure to the equipment. The side section 19 includes apertures 51 (FIG. 5) which permits flow between the pipelines and extension conduits.

The chamber 34 may be subdivided horizontally or vertically by walls 70 or floors 72, respectively. The walls 70 serve as vertical bulkheads limiting flooding damage, defining equipment areas and supporting the top portion 20. The floors 72 provide additional floor space and increase the longitudinal stiffness of the structure. Interior columns (not shown) which are located within the chamber 34 and extend from the base to the top portion may also be used to support the top portion.

As noted above, the top portion is a smooth surface permitting the unobstructured movement of an ice sheet over the structure. In this manner, the horizontal load resulting from contact between the structure and ice sheet is substantially reduced since the ice sheet is not required to fail in a crushing mode commonly associated with conventional offshore arctic structures. Rather, the ice sheet is permitted to ride-over the structure remaining substantially intact.

Figure 5:
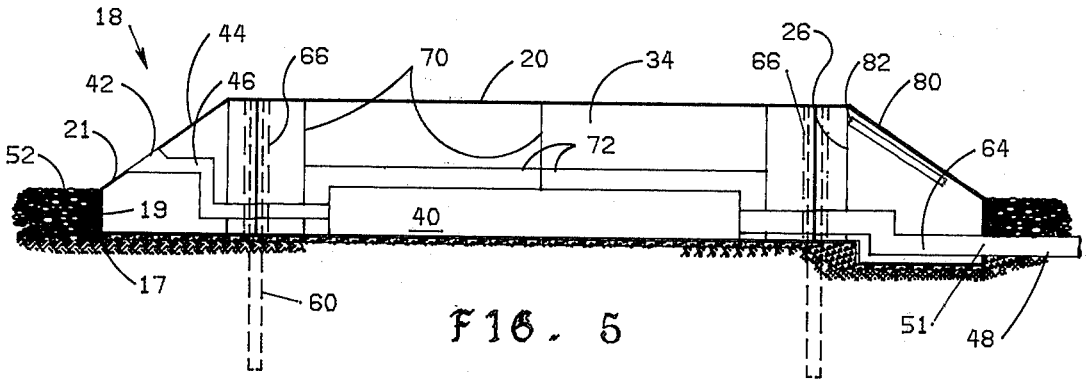
FIG. 5 is a cross-sectional view taken along line 5—5 of FIG. 4 illustrating an interior elevation view of the structure.

If excessive ice loads are expected it may be desirable to fix the structure to the sea bed. In the preferred embodiment a series of pile guides 66 extend from the base portion to the top portion and are located at the intersection of a lateral web member 30 with the bulkhead 26. As illustrated in FIG. 5, the pile guides 66 secure the piles 60 which extend therethrough into the sea floor. The piles are fixed within the guides by a grout mixture or similar means well known in the art. In this manner, the structure is securely mounted to the sea floor. Alternatively, the compartments may be filled with sand, gravel or the like for additional stability after the structure is resting on the sea floor. Thus, the side walls are reinforced when the water or soil-fill material within the compartments is permitted to freeze. Due to the fairly large mass of frozen matter immediately behind the wall, the structure has additional strength to resist localized damage resulting from the striking ice sheets. In such a case, the bulkhead 26 is designed to withstand the expansion force associated with the freezing water or soil-fill material within the compartments. This can be accomplished by either increasing the thickness of the bulkhead or bracing the bulkhead with gusset plates (not shown). For maximum stability, both of the above fixing means (piles plus filling of compartments) may be used.

Figure 6A:
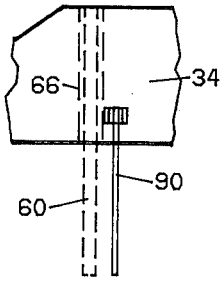
FIGS. 6A and 6B are details of an auxiliary pile means to enhance the stability of the structure.
Figure 6B:
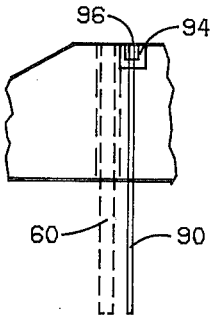

Referring to FIGS. 6A and 6B, heat pipes or air convection piles 90 (A/C piles) may be installed immediately adjacent each pile 60 for additional capacity. The heat pipes or A/C piles serve to withdraw heat from the surrounding soil adjacent each pile thereby accelerating the freezing of the soil around each pile and increasing the pile's capacity. Heat pipes and A/C piles are well known in the art. Reference is made to an article entitled "Passive Refrigeration For Arctic Pile Support" by J. W. Galate presented at the Petroleum Engineering Conference, Tulsa, Olkahoma, Sept. 21–25, 1975 (See *Transactions Of ASME, Journal Of Engineering For Industry,* Volume 98, Series 2, Number 2, pp. 695–700 (May 1976)) for a more detailed discussion of these devices. Typically, the heat pipes or A/C piles would be mounted adjacent each pile 60 and extend from below the sea floor, i.e. 10–30 feet, into the structure. Since heat pipes and A/C piles require a flow of air across the top of the unit to function satisfactorily, the top of each pipe or A/C pile should terminate in an open area such as the chamber 34, FIG. 6A, or a small open compartment 94 on the top portion 20, FIG. 6B. The compartment 94 would include an open screen 96 mounted flush with the surface of the top portion. Thus, the top portion is still smooth and can support the overriding ice without undue interference, yet the screen permits the flow of air into and out of the compartment 94. Fans (not shown) may be used to circulate the air within the chamber 34 when the pipes or A/C piles terminate in the chamber 34.

In freezing arctic temperatures, ice sheets have a tendency to adhere to the outer surfaces of an offshore structure and, therefore, substantially increase the horizontal load on the structure. To reduce this horizontal load the outer surface of the top portion and side walls may be chemically treated or heated to reduce this adhesion phenomenon (termed "adfreeze load"). Chemically, the outer surface of the side walls and top portion may be coated with a thin film 80 of polymeric material such as polyurethane. In this manner, the contacting surface has a lower adhesion factor and, therefore, a lower adfreeze load. Alternatively, the side walls and top surface may include thermal heat panels 82 on the inside surface which elevate the temperature of the metal surface thereby inhibiting the adfreeze phenomenon since freezing temperatures are a prerequisite to adhesion between the ice sheet and the metal structure.

The top portion of the structure is designed to support not only the overriding ice sheets (during the winter months) and waves (during the summer onths) but also helicopters during ice-free periods and the pile installation equipment which is required to place the piles. Typically, the load from pile installation equipment is transmitted into an adjacent pile guide 66 thereby preventing overstressing of the top portion and side walls. Ports (not shown) may be installed in the top portion to provide access means for personnel and equipment between the top portion and the interior chamber.

MODEL TESTING AND DESIGN EXAMPLE

Applicant has conducted model tests and theoretical calculations which indicate that the lateral loads associated with the ice crushing failure mode on conventional offshore structures is seven to ten times greater than the lateral load of an ice sheet flexing and riding over applicant's structure.

Referring to Table I below, the calculated lateral load on a structure of the present invention having a 45° sloped wall and contacted by an ice sheet 7 feet thick with a flexural strength of 100 pounds per square inch (psi) is 40 kips per foot of width of structure (see column 1 of Table I). Applicant's model test (column 2) which included similar geometric and environmental parameters (45° sloped walls, 7 feet thick ice sheet, and 110 psi flexural strength of ice) confirmed that the calculated value was accurate (as indicated, the scaled lateral load in the model test was 39 kips per foot of width of structure as compared to the calculated load of 40 kips per foot of width).

In the last column of Table I the calculated lateral load resulting from an ice crushing failure mode is illustrated. The major differences in this calculation compared with the prior calculation were the assumptions that the side of the structure was vertical rather than sloped and that the ice sheet was frozen solidly to the structure thereby preventing ice rideover. Thus, unlike the previous calculation, the lateral load is now a function of the crushing strength of the ice (assumed 400 psi based on design codes). The resulting lateral load on the structure is calculated to be 400 kips per foot of width. In other words, the lateral load due to a crushing failure is ten times larger than the load resulting from the flexible, ride-over mode possible with applicant's invention.

Similar calculations were performed with an ice sheet thickness of 15 feet. The lateral load resulting from a crushing failure mode was 860 kips per foot of width whereas the lateral load resulting from the flexible, ride-over mode employing applicant's invention was 130 kips foot of width (an 85% reduction).

TABLE I

| | Calculated | Model Test | Calculated |
|---|---|---|---|
| Mode of Contact: | Ride-Over | Ride-Over | Crushing |
| Angle of Sloped Wall of Structure (degrees) | 45 | 45 | 90" |
| Ice Sheet: | | | |
| Flexural Strength (psi) | 100 | 110 | (N/A) |
| Crushing Strength (psi) | (N/A) | (N/A) | 400 |
| Mode of Contact | Ride-over | Ride-over | Crushing |
| Lateral Load (Kips/Foot) with ice sheet thickness of 7 feet | 40 | 39 | 400 |
| Lateral Load (Kips/Foot) with ice sheet thickness of 15 feet | 130 | — | 860 |

The calculations of ride-over forces ignore the effect of adfreeze. However, if adfreeze is anticipated the surface of the structure may be chemically treated or heated to partially reduce the adfreeze load. If the structure is treated, the adfreeze force will be 5 psi or less or approximately 85 kips per foot of width with a 7 feet thick ice sheet. While this load is twice that due to the ride-over force (85 kips/foot compared to 40 kips/foot) it is still only one-fifth of that due to the crushing force (400 kips/foot).

Obviously, several modifications and changes to the apparatus described above will be apparent to those skilled in the art based on applicant's disclosure. However, it is applicant's intent to cover all such equivalent modifications and variations which fall within the scope of the invention.

What is claimed is:

1. An offshore structure adapted for use in a body of water having ice sheets floating on its surface, said structure comprising:

a base capable of being fixedly attached to the floor of said body of water; and a generally frustum shaped upper section having sides which slope upwardly and inwardly and a substantially horizontal top portion attached to said base, said horizontal top portion having a generally smooth and unobstructed top surface capable of supporting said ice sheets, said structure being sized so that said substantially horizontal top portion is located at or near the surface of said body of water such that encroaching ice sheets will be deflected upwardly by said sloped walls onto said smooth and unobstructed top surface and permitted to flex and ride over said structure and return to the surface of said body of water substantially intact.

2. The offshore structure of claim 1 wherein at least one horizontal cross-section of said frustum shaped upper section is circular in shape.

3. The offshore structure of claim 1 wherein at least one horizontal cross-section of said frustum shaped upper section is square in shape.

4. The offshore structure of claim 1 wherein at least one horizontal cross-section of said frustum shaped upper section is rectangular in shape.

5. The offshore structure of claim 4 wherein the rectangular horizontal cross-section has a length-to-width ratio which does not exceed 2:1.

6. The offshore structure of claim 1 wherein said structure further comprises heating means attached to the inner surfaces of said frustum shaped upper section for elevating the temperature of said upper section so as to reduce the adhesion of the ice sheet to said upper section.

7. The offshore structure of claim 1 wherein said structure further comprises a chemical coating on the outer surfaces of said frustum shaped upper section so as to reduce adhesion of the ice sheet to said upper section.

8. An offshore structure adapted for use in a body of water having a surface and a floor and having ice sheets floating on the surface, said structure comprising:

a base;

sloped walls, each having an upper end and a lower end, attached to the base at the lower end and sloping upwardly and inwardly; and a substantially horizontal top portion capable of supporting the ice sheets and having a substantially smooth and unobstructed surface attached to the top ends of the sloped walls, the top portion located at or near the surface of the body of water so that the floating ice sheets are deflected by the sloped walls onto the top portion and flex and ride over the structure and return to the water surface substantially intact.

9. The offshore structure of claim 8 wherein the structure further comprises means for fixing the structure to the floor of the body of water.

10. The offshore structure of claim 9 wherein the fixing means further comprises:

a plurality of pile guides attached at one end to the top portion and at the other end to the base; and a plurality of elongated members which are fixed at one end within the pile guides, pass through the base of the structure and are embedded at the other end in the floor of the body of water.

11. The offshore structure of claim 10 wherein the structure further comprises a plurality of ballasting compartments located in the structure and capable of being flooded to submerge the structure so that the top portion is located substantially at the water surface.

12. The offshore structure of claim 11 wherein the ballasting compartments are formed continuously along the periphery of the interior of the structure thereby forming an interior chamber which is bounded on the top by the top portion, on the bottom by the base, and on the sides by the ballasting compartments.

13. The offshore structure of claim 12 wherein the ballasting compartments further comprise web members connected to the base, to the sloped walls, and to the top end of the elongated members so as to reinforce the structure, whereby lateral loads resulting from the interaction of the ice sheets and the structure are transmitted from the sloped walls through the web members to the elongated members for dissemination into the floor of the body of water.

14. The offshore structure of claim 8 wherein:

the base is capable of being embedded a preselected amount in the floor of the body of water to prevent scouring below the base; and the structure includes means for preventing scouring adjacent to the outer edge of the base.

15. The offshore structure of claim 14 wherein the means for preventing scouring include gravel placed on the floor of the body of water and circumscribing the base, the depth of the gravel being substantially equal to the preselected amount that the base is embedded in the floor of the body of water.

16. The structure of claim 8 wherein the structure further comprises:

inlets supported within the sloped walls permitting the intake of water from the body of water through the inlets; and means for pumping the intake water from the inlets through a pipeline to shore, said pumping means supported on the base within the structure.

17. An offshore structure adapted for use in a body of water having a surface and a floor and having ice sheets floating on the surface, said structure comprising:

a base located on the floor of the body of water;

means for attaching the base to the floor;

an upper section which is frustum shaped and has a substantially horizontal top portion capable of supporting the ice sheets, the top portion having a substantially smooth and unobstructed surface, the upper section attached to the base so that the top portion is located at or near the surface of the body of water so as to allow encroaching ice sheets to flex and ride over the structure and return to the surface of the body of water substantially intact;

a work platform located in the structure and below the surface of the body of water; and a plurality of ballasting compartments disposed in the structure.

18. The offshore structure of claim 17 wherein the structure further comprises:

inlets supported within the sloped walls permitting the intake of water from the body of water through the inlets; and means for pumping the intake water from the inlets through a pipeline to shore, said pumping means supported on the base within the structure.

19. The offshore structure of claim 17 wherein the structure further comprises heating means attached to the inner surfaces of the upper section for elevating the temperature of the upper section so as to reduce the adhesion of the ice sheet to the upper section.

20. The offshore structure of claim 17 wherein the structure further comprises a chemical coating on the outer surfaces of the upper section so as to reduce adhesion of the ice sheet to the upper section.

21. An offshore structure adapted for use in a body of water having a surface and a floor and having ice sheets floating on the surface, said structure comprising:

a base;

means for attaching the base to the floor;

sloped walls, each having an upper end and a lower end, attached to the base at the lower end and sloping upwardly and inwardly;

inlets supported within the sloped walls permitting the intake of water from the body of water;

means for pumping the intake water from the inlets through a pipeline to shore, the pumping means supported on the base;

a plurality of ballasting compartments attached to and located about the periphery of the base; and a substantially horizontal top portion capable of supporting the ice sheets attached to the top ends of the sloped walls and located at or near the surface of the body of water, the top portion having substantially smooth and unobstructed surface so that the floating ice sheets are deflected by the sloped walls onto the top portion, ride over the structure, and redurn to the water surface.

22. In an offshore structure located in a body of water having ice sheets floating on its surface, a method for reducing the loads imposed on said offshore structure by the movement of said ice sheets, said method comprising the steps of:

providing said offshore structure with a generally frustum shaped upper section capable of deflecting said floating ice sheets upwardly and capable of supporting said ice sheets;

positioning said offshore structure in said body of water so that the top of said frustum shaped upper section is located at or near the surface of said body of water; and permitting said floating ice sheets to deflect upwardly, ride over said offshore structure and return to the surface of the water substantially intact.

23. The method of claim 22, said method further comprising the step of attaching heating means to the inner surfaces of said frustum shaped upper section for elevating the temperature of said upper section so as to reduce the adhesion of the ice sheet to said upper section.

24. The method of claim 22, said method further comprising the step of applying a chemical coating on the outer surfaces of said frustum shaped upper section so as to reduce adhesion of the ice sheet to said upper section.

25. The method of claim 22, said method further comprising the step of fixing said structure to the floor of said body of water by means of a plurality of elongated members which pass through said structure and are embedded in the floor of said body of water.

* * * * *